US009038956B1

(12) United States Patent
Bryant

(10) Patent No.: US 9,038,956 B1
(45) Date of Patent: May 26, 2015

(54) DEVICES CONFIGURED TO PROVIDE PRE-LAUNCH SUPPORT OF KITES

(71) Applicant: Oscar Bryant, Roanoke, VA (US)

(72) Inventor: Oscar Bryant, Roanoke, VA (US)

(73) Assignee: NMERXION LLC, Roanoke, VA (US)

( * ) Notice: Subject to any disclaimer, the term of this patent is extended or adjusted under 35 U.S.C. 154(b) by 111 days.

(21) Appl. No.: 13/890,834

(22) Filed: May 9, 2013

(51) Int. Cl.
*B64C 31/06* (2006.01)
*A63H 27/08* (2006.01)

(52) U.S. Cl.
CPC ..... *A63H 27/08* (2013.01)

(58) Field of Classification Search
USPC ..... 244/155 R, 153 R, 1 R; 248/127, 150, 248/153
See application file for complete search history.

(56) References Cited

U.S. PATENT DOCUMENTS 3,680,712 A * 8/1972 Jurasek ..... 211/59.2
4,117,936 A * 10/1978 Dawson ..... 211/50
4,629,086 A * 12/1986 Trubiano ..... 220/7
4,844,527 A * 7/1989 Ray ..... 294/19.2
6,135,309 A * 10/2000 Royster ..... 220/629
6,213,317 B1 * 4/2001 Mutert et al. ..... 211/181.1
8,038,805 B2 * 10/2011 Anderson et al. ..... 134/58 D

* cited by examiner

*Primary Examiner* — J. Woodrow Eldred
(74) *Attorney, Agent, or Firm* — Rhodes IP PLC; Christopher R Rhodes

(57) ABSTRACT

Certain embodiments described herein are directed to devices configured to retain, at least for some period, and provide pre-launch support kites such as stunt kites. In certain instances, the device positions stunt kites of various sizes and design, including, for example, delta wing kits, diamond kits and foil kits, in a reclined position to provide pre-launch stability and wind flow/spill-over across the face of the kite to help prevent unintentional or premature launch. If desired, optional control line upright supports can be present that permit minimum control line pull-back thereby reducing the recline of the kite to bring the face of the kite into the wind and thereby launch the kite. The control line upright supports may also prevent the kite from falling completely face down on the surface, thereby requiring a reset of the kite on the device.

20 Claims, 13 Drawing Sheets

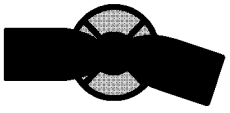
FIG. 1B
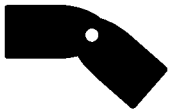
FIG. 1C
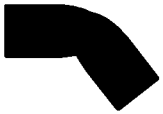
FIG. 1D
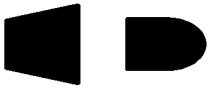
FIG. 1E
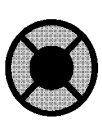
FIG. 1G
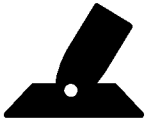
FIG. 1F
FIG. 1H
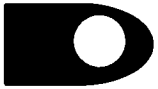
FIG. 1J
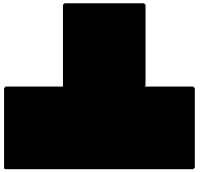
FIG. 1K
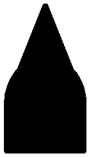
FIG. 1L
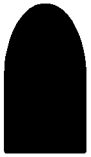
FIG. 1M
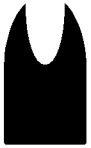
FIG. 1N

DEVICES CONFIGURED TO PROVIDE PRE-LAUNCH SUPPORT OF KITES

TECHNOLOGICAL FIELD

Certain embodiments described herein are directed to devices and methods for retaining and/or providing pre-launch support of a kite.

BACKGROUND

Kites come in many different configurations. In particular, multi-line stunt kits include, but are not limited to, two line, four line, delta wing, diamond, and foil.

SUMMARY

Certain aspects, examples and embodiments described herein are directed to devices for pre-launch stabilization of multi-line stunt kites allowing for kite recline support facilitating, for example, wind spill-over, control line management, and requiring no anchor, stake, tether, kite modification or attachment for the kite or the control lines. In some instances, a multi-line stunt kite pre-launch support device is provided that permits one person to launch such stunt kites without the assistance of other individuals. In other instances, a multi-line stunt kite pre-launch device is provided which is adaptable for use with all types of such stunt kites, including two line, four line, delta wing, diamond and foil. In additional configurations, a multi-line stunt kite pre-launch support device is provided for facilitating the launch of such kites even in variable wind and terrain conditions.

In a first aspect, a device comprising a pair of rear support legs, and a pair of front support legs each coupled to a respective one of the pair of the rear support legs, the pair of support legs together forming a structure sized and arranged to retain a kite for a first period and permit launching of the kite at a second period is provided.

In certain embodiments, the device can include a cross-member coupled to each of the front support legs. In other embodiments, each front support leg is coupled to a rear support leg through a removable coupler. In some examples, the device can comprise a pair of extension legs each coupled to a respective one of the pair of the front support legs, and a pair of control line rest legs each coupled to a respective one of the pair of extension legs. In some instances, each extension leg is coupled to a rear support leg through a removable coupler. In other configurations, each control line leg is coupled to an extension leg through a removable coupler. In further examples, at least one of the control line legs comprises a rest configured to receive a control line. In some embodiments, the pair of front support legs are arranged at an obtuse angle, relative to a resting surface, when coupled to the pair of rear support legs, and the rear support legs are arranged at an acute angle, relative to the resting surface, when coupled to the front support legs. In certain embodiments, the extension legs are arranged substantially parallel to the resting surface when coupled to the rear support legs. In other embodiments, the control line legs are arranged orthogonal to the extension legs when coupled to the extension legs. In other embodiments, the control line legs are coupled to the front support legs. In further embodiments, the pair of front support legs are configured to provide an obtusely angled rest constructed and arranged to receive and retain a kite prior to launch of the kite. In some embodiments, the rest comprises the front support legs coupled to each other through a cross member. In other embodiments, the rest comprises the front support legs crossed to form an "X" shape and coupled to each other with a coupler. In certain examples, the cross-member couples to one front support leg at one end of the cross member and couples to the other front support leg at an opposite end of the cross member. In other examples, the cross-member couples to the front support legs at a position other than the ends of the cross-member. In further examples, the length of the cross-member is adjustable. In some embodiments, the control line legs are coupled to each other through an additional cross-member. In certain examples, the cross-member couples to one control line leg at one end of the cross member and couples to the other control line leg at an opposite end of the cross member. In other examples, the cross-member couples to the control line legs at a position other than the ends of the cross-member. In some embodiments, the length of the cross-member is adjustable. In additional embodiments, each control line leg comprises a U-shaped element configured to retain a control line.

In another aspect, a kit comprising a plurality of members configured to couple to each other to provide a device configured to provide pre-launch support of a kite, the plurality of members comprising a pair of rear support legs, a pair of front support legs each configured to couple to a respective one of the pair of the rear support legs, and a plurality of couplers configured to couple the plurality of members to provide the device configured to launch the kite is described.

In certain examples, the kit comprises instructions for using the device to provide pre-launch support of the kite. In other examples, the kit comprises instructions for assembling the plurality of members into the device. In some examples, the kit comprises a plurality of launch control rests configured to couple to at least one of the plurality of members. In certain embodiments, the plurality of members are each sized and arranged to be substantially the same width and length. In certain examples, the kit comprises at least one cross-member configured to couple to the pair of front support legs. In other examples, the plurality of members further comprise a pair of extension legs each configured to couple to a respective one of the pair of the front support legs. In some examples, the plurality of members further comprise a pair of control line rest legs each configured to couple to a respective one of the pair of extension legs. In certain instances, the kit comprises a pair of launch control rests each configured to couple to a respective one of the plurality of control line rest legs. In additional embodiments, the kit comprises at least one cross-member configured to couple to the pair of front support legs.

In an additional aspect, a method of pre-launch support of a stunt kite comprising positioning the stunt kite on a launch support device comprising a pair of rear support legs and a pair of front support legs each coupled to a respective one of the pair of the rear support legs, the pair of support legs together forming a structure sized and arranged to retain a kite, and launching the kite by applying a force to a control line coupled to the kite to lift the kite away from the launching device is disclosed.

In certain examples, the method comprises separately positioning the control lines over a control line leg rest. In other examples, the method comprises pulling the control lines in a direction away from the front support legs to launch the kite. In some embodiments, the method comprises adjusting the angle of the front support legs. In other embodiments, the method comprises adjusting the angle of the rear support legs.

In another aspect, a method of facilitating launching of a stunt kite, the method comprises providing a launch support device comprising a pair of rear support legs, and a pair of front support legs each coupled to a respective one of the pair of the rear support legs, the pair of support legs together forming a structure sized and arranged to retain a kite for a first period and permit launching of the kite at a second period, and providing instructions for using the launching device to launch a kite is described.

In an additional aspect, a device comprising a pair of rear support legs, a pair of front support legs each coupled to a respective one of the pair of the rear support legs, the pair of support legs together forming a structure sized and arranged to retain a kite for a first period and permit launching of the kite at a second period, and a pair of control line support members each coupled to a respective one of the pair of the front support legs, the pair of control line support members and pair of front support legs together configured to prevent a kite placed between the front support legs and the control line support members from falling out of the device is described.

In certain embodiments, the device can comprise a pair of extension leg members each coupled to a respective one of the pair of the front support legs and positioned between the front support leg and the control line support member. In other embodiments, each of the members is coupled to another member through a removable coupler.

Additional aspects, examples, embodiments and configurations are described in more detail below.

BRIEF DESCRIPTION OF THE FIGURES

Certain illustrative configurations are described in more detail below to provide a user friendly description of the technology described herein in which:

FIGS. 1B-1D show illustrations of various types of couplers, in accordance with certain examples;

FIGS. 1E-1F show illustrations of various shapes of end caps, in accordance with certain examples;

FIGS. 1G-1H show illustrations of top and side view of an implementation of a swivel-type of end cap, in accordance with certain examples;

FIGS. 1J-1K show illustrations of various cross-bar connectors, in accordance with certain examples;

FIGS. 1L-1N show illustrations of various control-lines rest end caps, in accordance with certain examples;

Figure 1A:
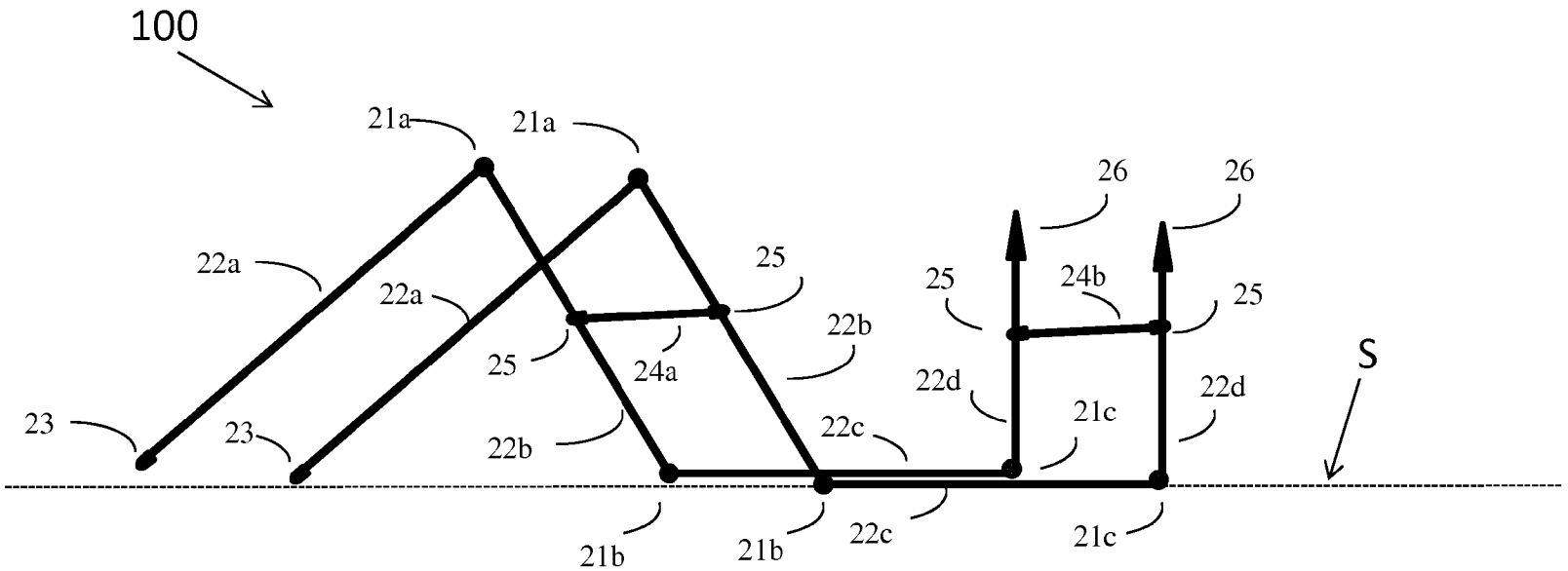
FIG. 1A is an oblique view of an illustrative configuration showing the device in an open and ready position, in accordance with certain examples.

It will be recognized by the person of ordinary skill in the art, given the benefit of this disclosure, that the particular lengths, widths and other dimensions of the various members of the devices described herein may be varied depending on the intended use of the device, the local environment, the size of the kit and other factors. Unless specified in the illustrations below, no particular size, height, width, footprint or other dimensions are required. Reference numerals are provided below for convenience and ease of illustration and, unless otherwise specified, designate corresponding parts throughout the various views and embodiments.

DETAILED DESCRIPTION

The devices described herein can be used with many different kinds of kites, and devices similar to kites, for retaining and/or providing pre-launch support of the kites. The pastime of flying multi-line stunt kites has grown in popularity over the past 30 plus years. There are many styles and designs of multi-line stunt kites including two line, four line, delta wing, diamond, and foil. The method of flying stunt kites is essentially the same, allowing for certain differences in pitch and roll with four line kites. Maneuvering stunt kites involves pull-back of both control lines for movement in the direction of the leading edge and pull-back of one the control lines sets movement in the direction of the pulling control line. The launch of stunt kites involves either assistance from someone holding the kite, or an intricate balance of recline on the kite to allow wind spillover while the flyer moves to the handle end of the control lines in order to retrieve the handles and to pull-back for launch. Traditionally, a stake is set in the ground to hold the control handles and provide tension on the control line while the flyer walks the stunt kite to the extent of the control lines and reclines the kite, to a point of maintaining control line tension while allowing wind spill over to prevent launch, then returning to the handle end of the control lines. Given situations of wind variability with respect to speed and direction, and control line movement upon handle retrieval, premature launch frequently happens prior to flyer readiness, with the normal result of flight failure requiring a reset of the position of the stunt kite, and occasionally control line cuts or burns as a result of the flyer trying to regain control without use of control handles. It is difficult, particularly for a beginner stunt kite flyer (and for most flyers in the case of foil kites), to launch a multi-line stunt kite without assistance from someone to hold and then release the kite after the flyer has achieved launch readiness with appropriate wind conditions and control line handle grip.

In certain embodiments, the devices described herein generally includes a plurality of coupled members with one or more of the members cooperatively configured to retain the kite and/or provide pre-launch support of the kite. In some embodiments, one of the members may be configured at an obtuse angle with respect to a surface on which the device rests to permit the top portion of the kite to rest against the obtuse member and generally be positioned at an obtuse angle with respect to the resting surface of the device. In certain instances, an acute member (whose acute angle is relative to the resting surface) may be coupled to the obtuse member to enhance stabilization of the overall device. In some instances, one or more cross-members, control-line rests or other components may also be present and/or coupled to the obtuse member to assist in pre-launch support of the kite.

In certain examples and referring to FIG. 1A, a pre-launch support device 100 is shown as comprising various members and joints or couplers including couplers 21*a*-21*c*, members 22*a*-22*d*, cap members 23, cross-members 24*a* and 24*b*, members 25 and launch control string rests 26. Members 22*b* generally form an obtuse angle with respect to a surface S on which the device 100 may reside. Members 22*a* are positioned at an acute angle with respect to the surface and couple to the members 22*b* through the joints 21*a* to form a generally inverted V-shaped structure. The members 22*a* may couple to optional cap members 23, which can be configured to generally assist the device 100 from moving from a stationary position. Members 22*b* also couple to members 22*c* through couplers 21*b*. Members 22*c* are generally positioned substantially parallel to the surface S during use of the device 100. Members 22*c* couple to members 22*d* through couplers 21*c*. Members 22*d* are configured to be substantially orthogonal to members 22*c* during operation of the device 100. To provide such an orthogonal configuration, the couplers 21*c* can be configured at about a 90 degree angle. One or more cross-members 24*a*, 24*b* can be present between the various members to provide further stability. The cross members can couple to the other members through couplers 25. As discussed in more detail below, cross-member 24*a* can be used to assist placement of the kite and retention of the kite by the stand before launching of the kite. The device 100 can also include launch control rests or caps 26 for use in holding any control lines which are coupled to the kite for flying the kite. While not shown, for ease of assembly, members 22*a*-22*c* may also be sized and arranged similarly such that a user assembling the device 100 need not determine which particular member goes where but instead can select any member for use as the various members 22*a*-22*c*.

In certain embodiments, couplers 21*a*-21*c* each may independently be fixed, rotating, articulating or otherwise adjustable elbow connectors that may include tension adjustments for retention of desire leg angle. If desired, the couplers may be by the same type or coupler of may be different types of couplers. For illustrative purposes only, FIGS. 1B-1D show various adaptations of fixed (FIG. 1D), rotating (FIG. 1C) or otherwise adjustable joints (FIG. 1B) that permit for adjustment of angles related to the readiness positioning of the various members to address variances in wind and terrain upon which it is placed, and to allow for various kite designs. In some examples, joints with center connectors also allow for cross-bar placement at the joints (see, for example, FIG. 2, part 24*c*) for additional stability of the device. In other examples, rotating joints, with or without tension adjustments, would also allow for folding of the cradle for easy transport and storage. The joints may also allow removal of the legs for complete deconstruction to further facilitate transport and storage. The joints may be constructed of wood, plastic, nylon, rubber, fiberglass or other suitable materials or combinations thereof.

In certain embodiments and referring again to FIG. 1A, the various members 22*a*-22*d* represents the legs (or spars) which may be of fixed or various lengths that may also be interchangeable to facilitate use with myriad kite designs. While not wishing to be bound by any particular member arrangement with respect to other members, member 22*a* in FIG. 1A can be considered a rear support leg, 22*b*—front support leg, member 22*c* can be considered an extension leg, and member 22*d* can be considered a control line rest leg. The legs may be dowels, rods or tubes (solid or hollow) and may be constructed of wood, plastic, nylon, carbon fiber, fiberglass, PVC or other such materials and combinations of such materials.

In certain examples and referring to FIGS. 1E-1H, various configurations of the end cap elements are shown. While not wishing to be bound by any particular theory, the end cap elements can act to protect the ends of the legs resting against the ground and may also deter movement of the device when in use. FIGS. 1E-1H (with FIG. FIG. 1G being a top view of FIG. 1D) show illustrative embodiments of the end cap which may be of various shapes and sizes, and may be hinged, to allow for additional support against the forces of wind across the face of the kite and cradle, and to insure placement integrity on various types of even or uneven terrain comprised of such material as dirt, rock, sand, gravel, grass or other material. The end cap may be constructed of wood, plastic, nylon, fiberglass, rubber, PVC or other such materials or combinations thereof.

In certain embodiments, members 24*a* and 24*b* represent the cross-bar or cross-member which provides for the connection of legs and can enhance the structural stability of the device 100. The cross-member may be present in different forms including, 24*a*—main cross-bar, 24*b*—control-line rest cross-bar, and 24*c* (shown in FIG. 2)—joint cross-bar. If desired, the device may be operated with a single cross-member or no more cross-members. For example, the various legs can be coupled to each other through a coupler, wires, a mesh, rope or other suitable devices to permit retention of the legs in a desired position. In other instances, a single cross-member can be present, e.g., cross-member 24*a* to provide a rest for areas of the kites such as delta wing and diamond. The cross-bar may be constructed of materials similar to the legs, and may be interchangeable with the legs to facilitate sizing adjustments related to kite design. In some instances, the cross-members can be adjustable such that the overall length may be changed to adjust the spacing between various members or legs of the device.

In certain examples and referring to FIGS. 1J-1K, one or more couplers can be used with the cross-members to couple the cross-members to the other members or legs of the device. FIGS. 1J and 1K show illustrative embodiments of couplers suitable for use with the cross-members. The cross-bar couplers may allow for adjustment of cross bar height and leg positions for example an H-shaped—wider leg spacing as shown in FIG. 1A, or T-shaped—more narrow leg spacing" shown in FIG. 5A) to accommodate various kite designs. The cross-bar connectors may be of a design to allow for the folding of the cradle, or may allow for removal of the cross-bar to facilitate folding of the cradle to facilitate storage and transport. The cross-bar connectors may be constructed of wood, plastic, nylon, fiberglass, rubber or other such light and sturdy material, and may allow for tension adjustment to better secure the cross-bar position.

In certain embodiments and referring to FIGS. 1L-1N, control-line rest end caps can be configured in many different manners including, for example, an extended U-shaped end cap that permits elevated placement and separation of control lines. FIGS. 1L and 1M show adaptions of the end cap which may be of various shapes, lengths and sizes. FIG. 1N shows a side view of a control line end cap, of which the spacing of the U-shaped element may be of various widths and depths. Control-line rest end caps may also be of a design that attaches by insertion into a control-line leg of tube (hollow) design. The control-line rest end cap may be constructed of wood, plastic, nylon, rubber, fiberglass or other suitable materials or combinations thereof.

Figure 2:
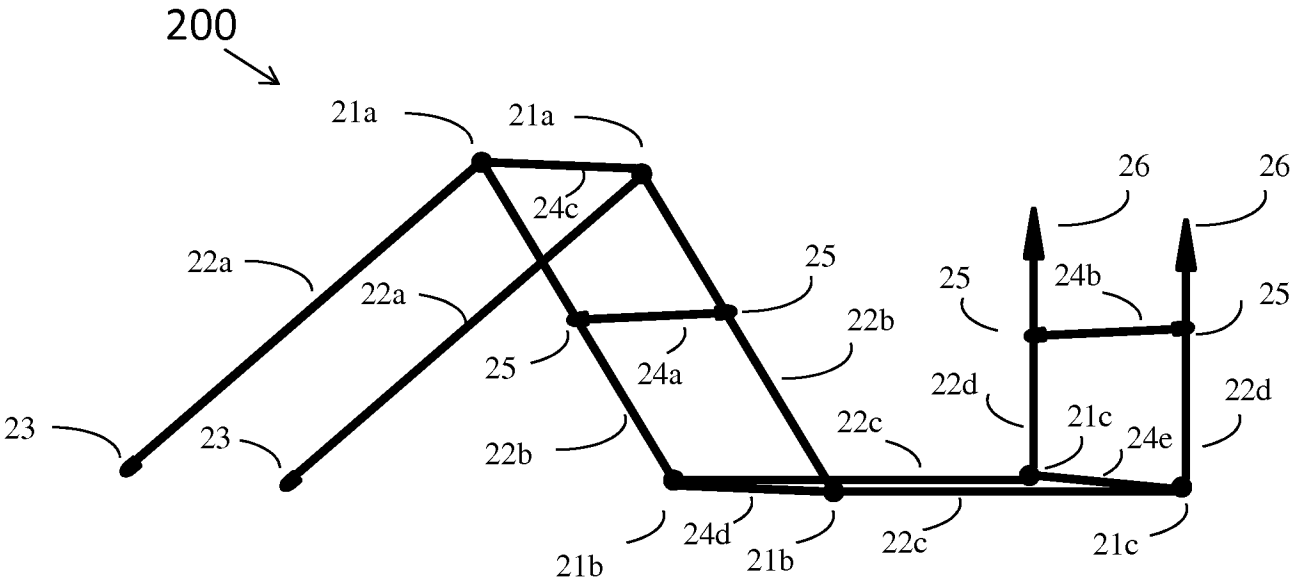
FIG. 2 is an oblique view of the device with support cross-bars shown coupled to leg couplers, in accordance with certain examples.

In certain examples and referring now to FIG. 2, another configuration of a device is shown. The device 200 includes elements similar to those described in reference to FIG. 1A and comprises optional joint cross-bars (part 24*c*) which provide additional device stability, and which may be removed for device transport and storage. The other members of the device 200 may be the same as those described in reference to FIG. 1A, e.g., the various other members may be one or more of those illustrative configurations shown in FIGS. 1B-1N and described in connection therewith.

Figure 3:
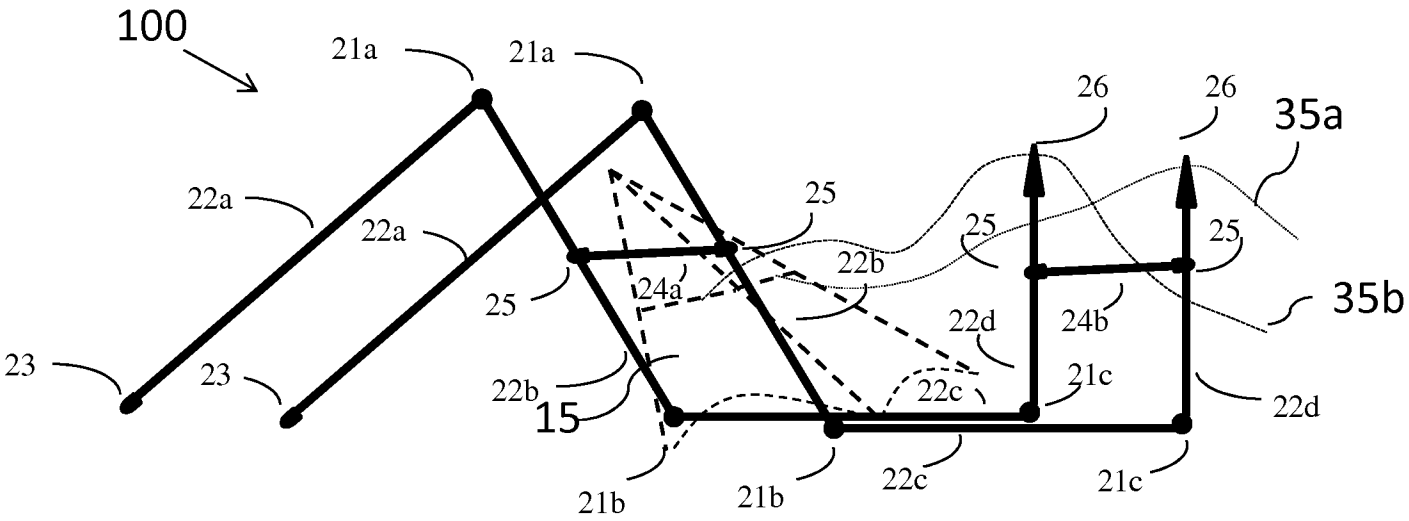
FIG. 3 is an oblique view of the device with the pre-launch positioned kite indicated with dashed lines and kite control-lines indicated with dotted lines, in accordance with certain examples.

In certain embodiments, and referring now to FIG. 3, the device 100 is shown as being configured to position a kite 15, indicated by dashed lines, and control lines 35*a*, 35*b* indicated by dotted lines. This figure represents the pre-launch placement of a stunt kite 15 and control lines 35*a*, 35*b*. The reclined position of the kite 15 against members 22*b* and cross member 24*a* allows for wind spill-over thereby avoiding unintended launch. The elevated positioning of control lines 35*a*, 35*b* allows sufficient line slack to insure the reclined position, and an upward movement of the control lines when drawn. The control line rests 26 also maintain separation of the control lines 35*a*, 35*b* and provides a visual of the lines to the flyer. As the control lines 35*a*, 35*b* are drawn or pulled by the flyer using the kite control handles, the leading-edge and front surface of the kite 15 will necessarily be brought into the wind and effect a launch. In case of insufficient wind during attempted launch by the flyer or variable winds, that would otherwise cause the kite to fall face forward, the members 22*d* and cross member 24*d* would retain the kite off the ground and prevent the flyer from having to reset the position of the kite. In the case of foil stunt kites, which by design have no sturdy frame, an open placement across the front incline or lower front legs 22*b* with the edges trailing to the back of the device allows for wind spillover and maintenance of pre-launch position until the control lines are drawn or pulled which will draw the face of the foil into the wind allowing it to bellow and effecting a launch. In the case of four line kites, the control-line rest cross-bar (part 24*b* as shown on FIG. 1A) may be used to rest the third and fourth control lines.

Figure 4:
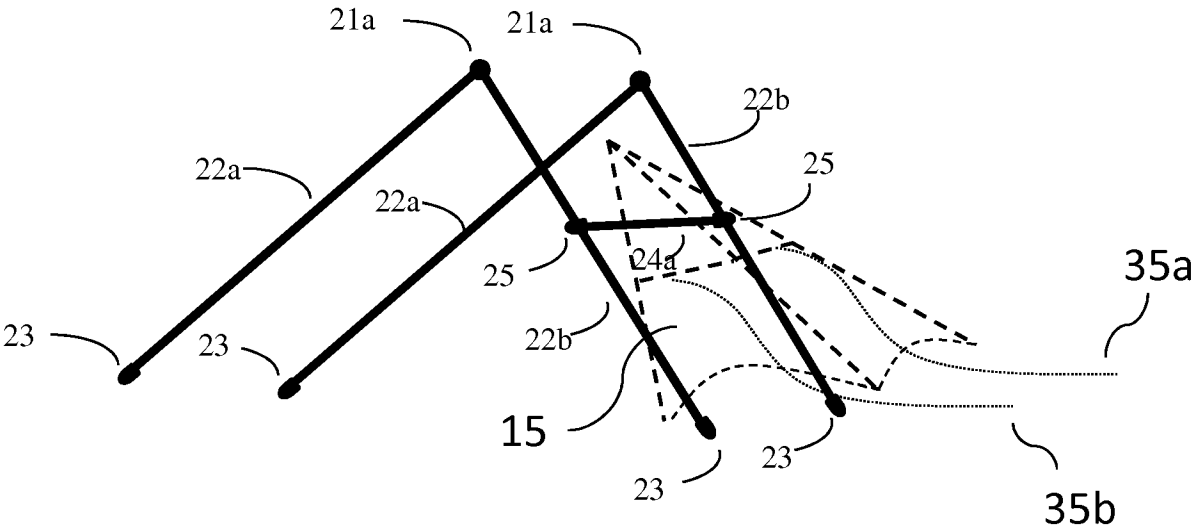
FIG. 4 is an oblique view of the device without the control-line rests and extension legs, showing the pre-launch positioned kite indicated with dashed lines and kite control-line indicated with dotted lines, in accordance with certain examples.

In certain instances and referring now to FIG. 4, the device is illustrated in an open and ready position, without control-line rests and legs, and with positioned in the cradle, a kite indicated by dashed lines and control lines indicated by dotted lines.

Figure 5A:
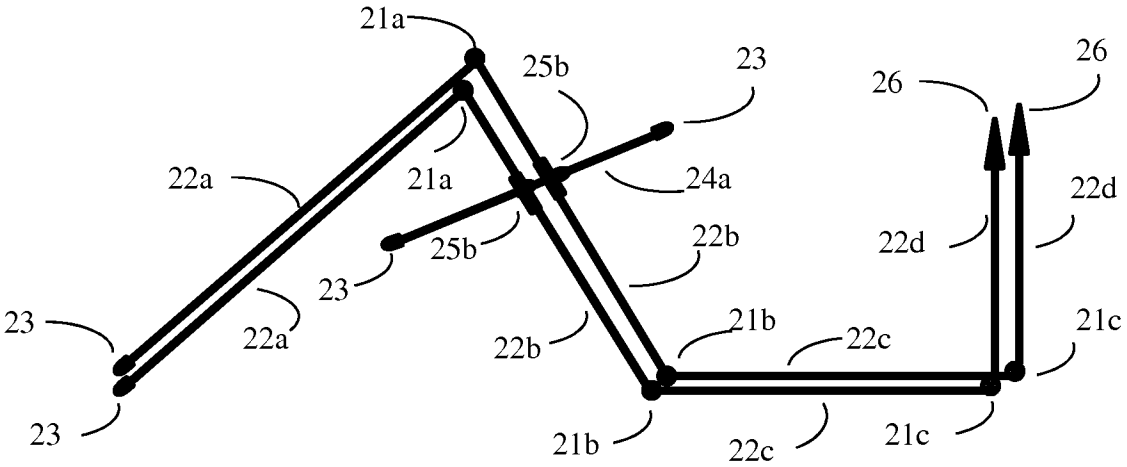
FIGS. 5A-5B is an oblique view of the device showing a "narrow leg spacing configuration of the cross-bar, in an open and ready position, with reference to parts and enlargements of certain referenced parts, in accordance with certain examples.
Figure 5B:
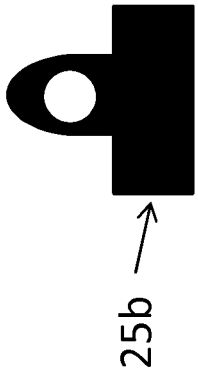

In other embodiments and referring now to FIG. 5A, the device is illustrated in an open and ready T-shaped—narrower leg spacing configuration, with all parts being the same as in FIG. 1A, with element 25*b* (shown in larger view in FIG. 5B) being depicted. Element 25*b* allows for adjustment of spacing between the legs 22*a*-22*d* in addition to height adjustment of the crossbar 24*a*. Element 25*b* may be constructed of wood, plastic, nylon, rubber, fiberglass or other such light and sturdy material, and may allow for tension adjustment to better secure the cross-bar position.

Figure 6:
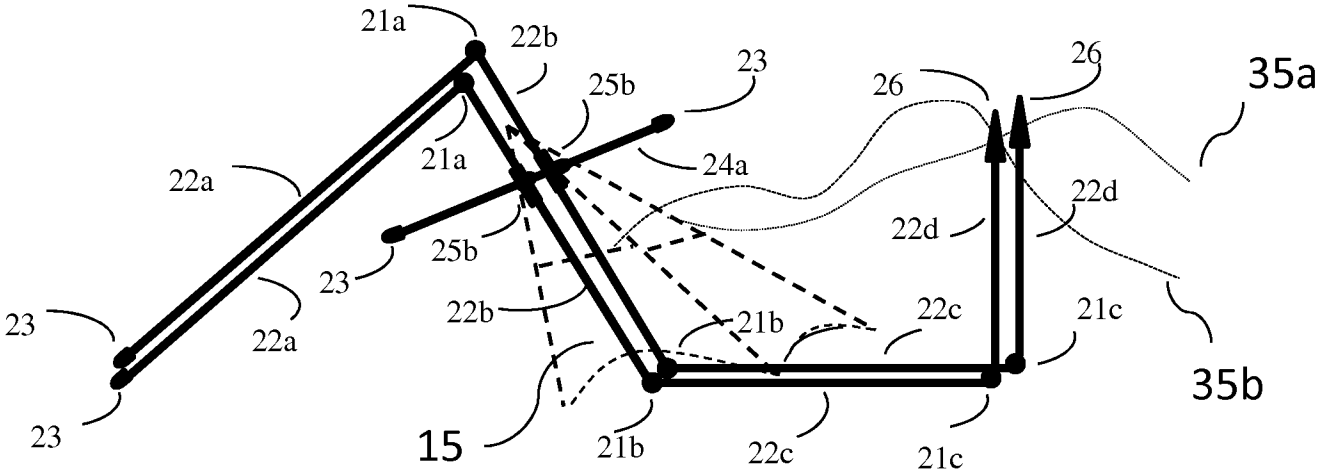
FIG. 6 is an oblique view of the device showing a—narrow leg spacing configuration of the cross-bar, with the pre-launch positioned kite indicated with dashed lines and control-lines, in accordance with certain examples.

Referring now to FIG. 6 wherein is shown the device in an open and ready T-shaped—narrower leg spacing configuration, and with positioned in the cradle, a kite indicated by dashed lines and control lines indicated by dotted lines.

Figure 7B:
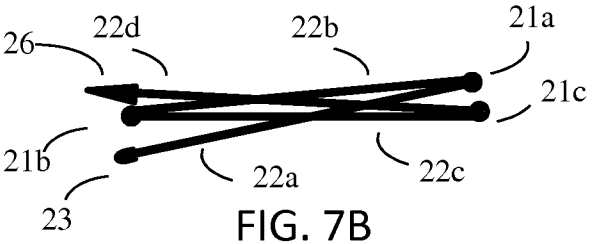
FIGS. 7A-7C is a view showing partial disassembly and folding of the device in preparation for storage and/or transport, in accordance with certain examples.
Figure 7A:
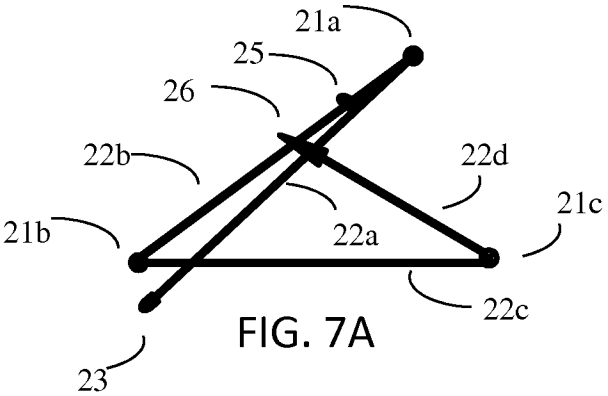
Figure 7C:
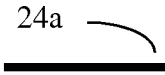

Referring now to FIGS. 7A-7C wherein is shown the device of FIG. 1A with the cross-bar (part 24*a*) removed and one side (FIG. 7A) shown in a partially folded position, and the other side (FIG. 7B) in a completely folded position. Removal of the cross-bar(s) and folding of each side allows for placement in a carry bag for easy transport and storage. In an alternative configuration, the various members can be disassembled to individual, component members and placed in a bag for easy transport.

Figure 8A:
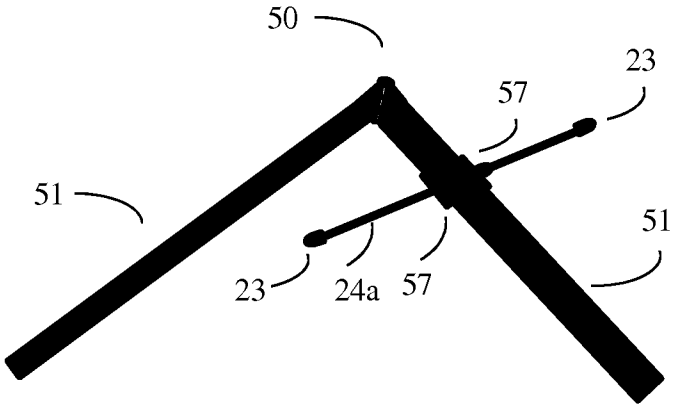
FIGS. 8A-8C is an oblique view of the device showing a folding "slat" structure adaptation including crossbar, and enlargement of certain parts for reference, in accordance with certain examples.
Figure 8B:
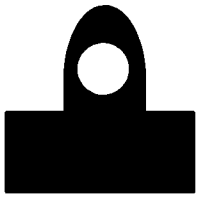
Figure 8C:
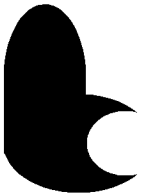

Referring now to FIG. 8 wherein is shown the device in a different 'slat' embodiment and in an open and ready configuration. The slat embodiment utilizes hinged slats instead of dowels, rods or tubes. Part 50 represents the hinged connector that connects the slats and allows for folding of the device. Part 51 represents the slats which may be of various lengths and widths and which may be constructed of wood, plastic, nylon, fiberglass or other such light and sturdy material. Part 57 represents the connector for the cross-bar (Part 24*a*), with FIG. 8B showing the cross-bar placement hole view of element 57, and FIG. 8C showing the slat connection view of element 8C.

Figure 9B:
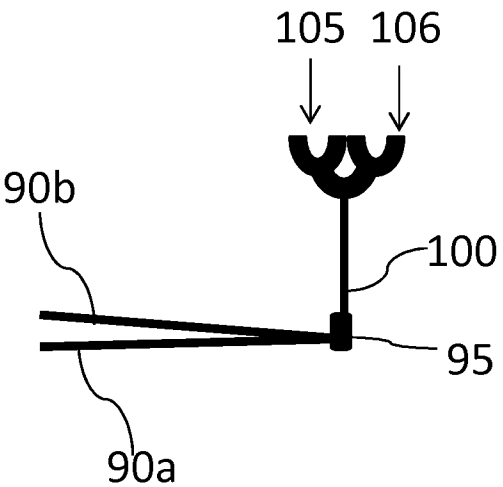
FIGS. 9A-9B is a view showing a configuration of the extension legs in an orthogonal placement with a single control line leg, and branching control line rests, in accordance with certain examples.
Figure 9A:
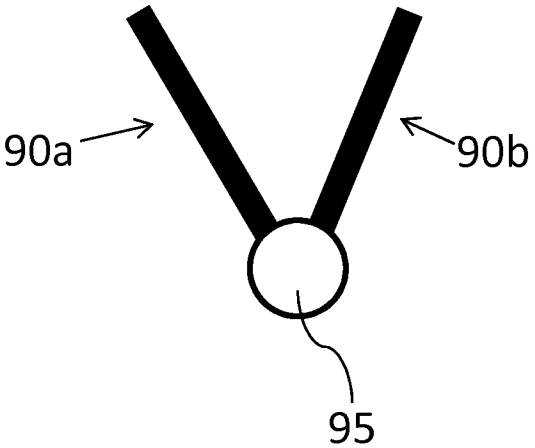

Referring now to FIGS. 9A and 9B, a top view (FIG. 9A) and side vide (FIG. 9B) of extension members and control line members are shown. In this configuration, the extension members 90*a*, 90*b* converge into a joint 95 that is coupled to a single control line member 100 rather than two control line members as shown in FIG. 1A and elsewhere. As shown in FIG. 9B, the control line member 100 may bifurcate or split into two or more separate rests or channels 105, 106 to permit placement of a single control line into each of the rests 105, 106.

Figure 10:
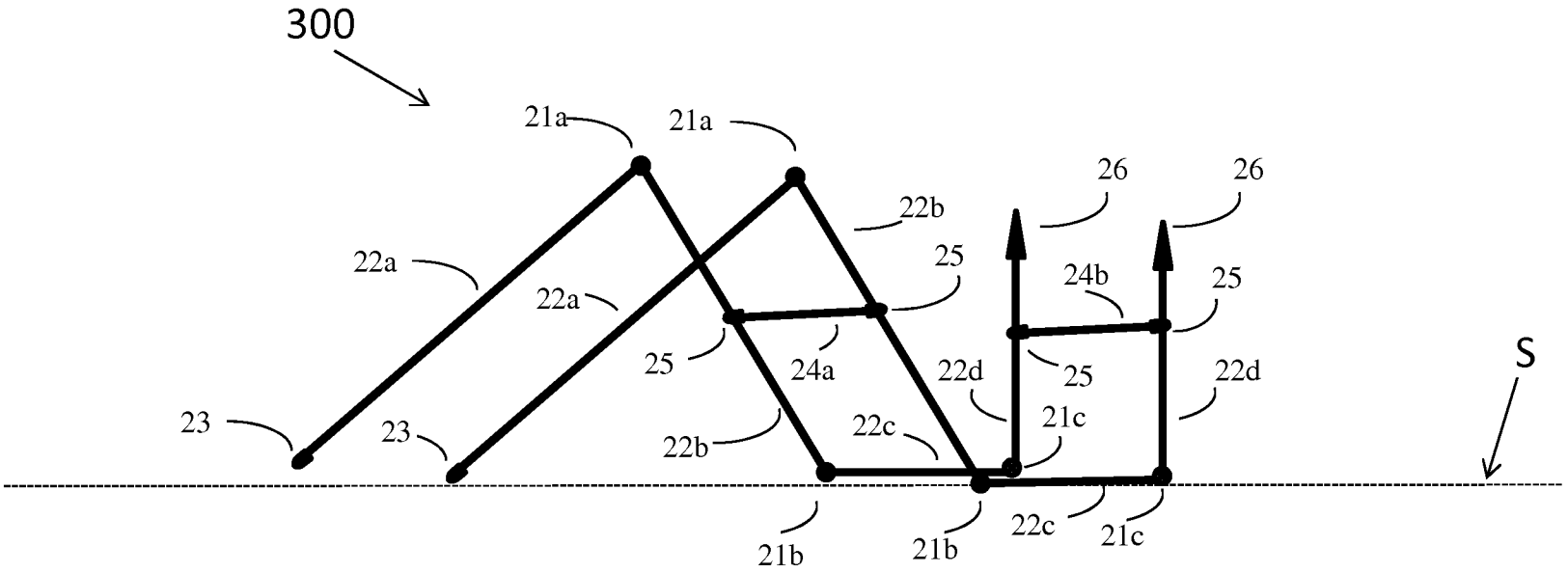
FIG. 10 is an oblique view of the device showing shorter extension legs, in accordance with certain examples.

Referring now to FIG. 10, another configuration of the device is shown. The device 300 is configured with shorter extension members 22*c*. In this configuration, smaller kites can be prevented from fully falling forward to a face down position by the control line members 22*d*. For example, the extension members 22*c* can be sized and arranged such that a kite placed in the groove or opening between the members 22*b* and 22*d* cannot generally fall forward out of the device. In this manner, fluctuations in wind direction, which may cause movement of the kite in the pre-launch device 300, will not generally result in the kite falling out of the device and force a user to walk back to the device to reposition the kite.

Figure 11:
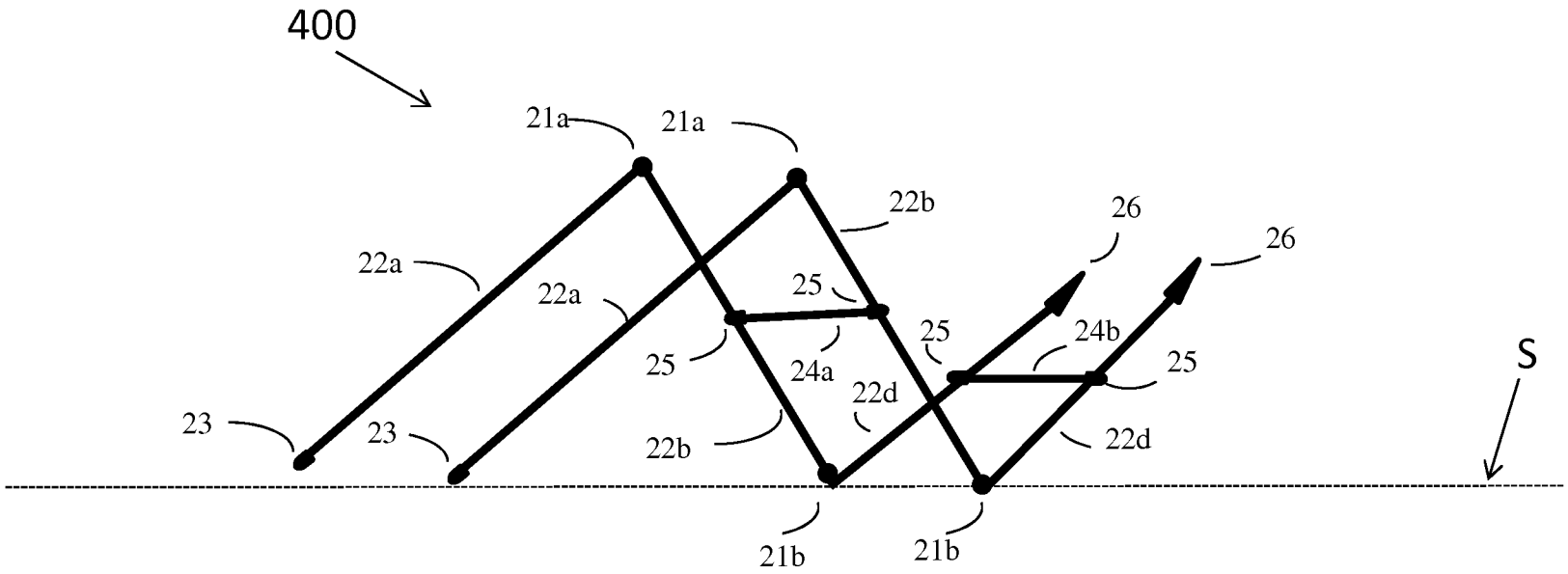
FIG. 11 is an oblique view of the device showing the control line legs coupled to the front support legs, in accordance with certain examples.

Referring now to FIG. 11, another configuration of the device is shown. The device 400 is configured with the control line members 22*d* coupled to the front support members 22*b*. As shown in FIG. 11, the control line members 22*d* are directly coupled to the support members 22*b* through the couplers 21*b* without any intervening members. Similar to FIG. 10, a kite placed into the opening formed by members 22*b*, 22*d* can move back to front while at the same time generally retaining the kite within the device. For example, a change in wind direction may push the kite initially placed against the surfaces of the members 22*b* so that it rests against the members 22*d* but does not generally fall out of or disengage the device 400.

Figure 12:
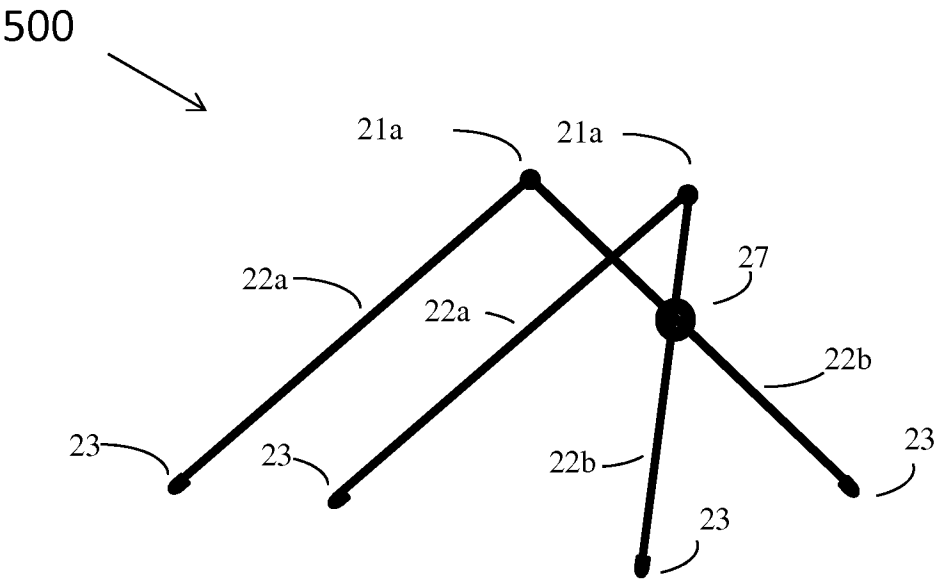
FIG. 12 is an oblique view of the device showing front and rear support legs, with the front support legs crossed and coupled.

Referring now to FIG. 12, another configuration of the device is shown. The device 500 is configured with the front support members 22*b* situated in a crossed position and coupled with couple member 27. This configuration allows for device stability without a cross member. While not shown, the components of FIG. 12 may be coupled to additional members, e.g., extension legs, control line support members and other components as described in connection with the other illustrative embodiments disclosed herein. While not shown, the rear legs may be crossed in the same manner as the front legs, allowing for either the front legs, or rear legs, or both to be crossed.

In certain embodiments, the devices described herein may be present in a kit form with the various members decoupled from each other to permit easy transport. If desired, the kit may include a kite, control lines and other materials or components commonly used to fly a kite. The kit can include a single type of device as described herein or may be configured to permit construction of two or more of the devices described herein.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples without departing from the spirit and scope of the technology described herein. Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A device comprising:

a pair of rear support legs each arranged at an acute angle, relative to a resting surface; and a pair of front support legs each coupled to a respective one of the pair of the rear support legs, the pair of front support legs each arranged at an obtuse angle, relative to the resting surface, to permit a kite to rest at an obtuse angle against the front support legs for a first period and to permit wind to be incident on the resting kite to push and retain the kite against the front support legs for the first period, the pairs of rear and front support legs together forming a structure sized and arranged to permit launching of the retained kite at a second period;

a pair of horizontal legs each coupled to a respective one of the pair of front support legs, the horizontal legs configured to rest on the resting surface; and a pair of control line legs each coupled to a respective one of the pair of horizontal legs, the pair of control line legs together arranged to receive and retain a control line coupled to the kite during the first period and to permit release of the control line during the second period to permit launching of the kite from the device.

2. The device of claim 1, further comprising a cross-member coupled to each of the front support legs.

3. The device of claim 1, in which each front support leg is coupled to a rear support leg through a removable coupler.

4. The device of claim 2, wherein each control line leg is orthogonal to the horizontal leg to which it is coupled.

5. The device of claim 4, in which each horizontal leg is coupled to a front support leg through a removable coupler.

6. The device of claim 4, in which each control line leg is coupled to the horizontal leg through a removable coupler.

7. The device of claim 4, further comprising a cross-member coupled to each of the control line legs, the cross member configured to receive and retain the control line coupled to the kite.

8. The device of claim 4, further comprising a cross-member coupled to each of the pairs of rear support legs.

9. The device of claim 8, further comprising a cross-member coupled to each of the control line legs, the cross member configured to receive and retain the control line coupled to the kite during the first period.

10. The device of claim 1, in which the obtuse angle of the pair of front support legs is configured to permit a top surface of the kite to rest against the front support legs and the horizontal legs are configured to permit a bottom surface of the kite to rest against the horizontal legs to retain the kit in the obtuse angle position in the device.

11. The device of claim 10, in which the front support legs are coupled to each other through a cross member.

12. The device of claim 11, in which the cross-member couples to one front support leg at one end of the cross member and couples to the other front support leg at an opposite end of the cross member.

13. The device of claim 11, in which the cross-member couples to the front support legs at a position other than the ends of the cross-member.

14. The device of claim 11, in which length of the cross-member is adjustable.

15. The device of claim 14, in which the control line legs are coupled to each other through an additional cross-member.

16. The device of claim 15, in which the additional cross-member couples to one control line leg at one end of the additional cross member and couples to the other control line leg at an opposite end of the additional cross member.

17. The device of claim 15, in which the additional cross-member couples to the control line legs at a position other than the ends of the additional cross-member.

18. The device of claim 15, in which the length of the additional cross-member is adjustable.

19. The device of claim 15, in which each control line leg comprises a U-shaped element configured to retain one of a pair of control lines coupled to the kite.

20. The device of claim 1, in which the control line legs are each coupled to a respective one of the horizontal legs through a joint that permits the control line leg to fold against the respective one of the horizontal legs.

* * * * *